US009520675B2

(12) United States Patent
Choi et al.

(10) Patent No.: US 9,520,675 B2
(45) Date of Patent: Dec. 13, 2016

(54) LEVER TYPE CONNECTOR

(71) Applicants: HYUNDAI MOTOR COMPANY, Seoul (KR); KYUNGSHIN CO., LTD., Incheon (KR)

(72) Inventors: Jong Pil Choi, Hwaseong-si (KR); Jae Ho Park, Incheon (KR)

(73) Assignees: Hyundai Motor Company, Seoul (KR); Kyungshin Co., Ltd., Incheon (KR)

( * ) Notice: Subject to any disclaimer, the term of this patent is extended or adjusted under 35 U.S.C. 154(b) by 0 days.

(21) Appl. No.: 14/846,275

(22) Filed: Sep. 4, 2015

(65) Prior Publication Data

US 2016/0164210 A1 Jun. 9, 2016

(30) Foreign Application Priority Data

Dec. 4, 2014 (KR) ..... 10-2014-0173290

(51) Int. Cl.
*H01R 13/44* (2006.01)
*H01R 13/641* (2006.01)
*H01R 13/629* (2006.01)

(52) U.S. Cl.
CPC ..... *H01R 13/641* (2013.01); *H01R 13/62933* (2013.01)

(58) Field of Classification Search
CPC ..... H01R 13/4538
USPC ..... 439/140, 141, 157
See application file for complete search history.

(56) References Cited

U.S. PATENT DOCUMENTS

| | | | | |
|---|---|---|---|---|
| 6,193,531 | B1 * | 2/2001 | Ito | H01R 13/62933 439/140 |
| 7,052,293 | B2 | 5/2006 | Koshy et al. | |
| 7,329,133 | B2 * | 2/2008 | Ishikawa | H01R 13/62938 439/140 |
| 8,038,455 | B1 * | 10/2011 | Moraes | H01R 13/4538 439/140 |
| 8,439,695 | B2 * | 5/2013 | Komiyama | H01R 13/62944 439/157 |
| 2006/0270255 | A1 | 11/2006 | Ishikawa et al. | |
| 2010/0227495 | A1 | 9/2010 | Matsumura et al. | |
| 2014/0127921 | A1 | 5/2014 | Shimizu et al. | |

FOREIGN PATENT DOCUMENTS

| | | | |
|---|---|---|---|
| JP | 2002-298978 | A | 10/2002 |
| JP | 2006-331925 | A | 12/2006 |
| JP | 2010-205552 | A | 9/2010 |
| JP | 2013-016315 | A | 1/2013 |
| KR | 10-2009-0044814 | A | 5/2009 |
| KR | 10-2013-0121644 | A | 11/2013 |
| KR | 10-2014-0006558 | A | 1/2014 |
| KR | 10-1348189 | B1 | 1/2014 |

* cited by examiner

*Primary Examiner* — Phuong Dinh
(74) *Attorney, Agent, or Firm* — McDermott Will & Emery LLP

(57) ABSTRACT

A lever type connector includes: a female housing having a box shape of which one portion is open; a male housing configured to be inserted into the female housing and provided with a plurality of male terminals; a lever configured to be rotatably coupled with an outer side of the male housing; and a movable plate configured to be mounted on a bottom surface of the male housing, have the bottom surface provided with a plurality of through holes through which the male terminals penetrate, and enclose the male terminal to protect the male terminals.

8 Claims, 20 Drawing Sheets

<PRIOR ART>

LEVER TYPE CONNECTOR

CROSS-REFERENCE TO RELATED APPLICATION

This application is based on and claims the benefit of priority to Korean Patent Application No. 10-2014-0173290, filed on Dec. 4, 2014 in the Korean Intellectual Property Office, the disclosure of which is incorporated herein by reference in its entirety.

TECHNICAL FIELD

The present disclosure relates to a lever type connector, and more particularly, to a lever type connector capable of preventing a terminal from being broken, and reducing size of terminals.

BACKGROUND

The number of connector circuits for circuit processing has increased due to increase in electric components through increase in convenience devices such as multimedia, GPS, and information communication equipment, along with increase in number of wirings for various data and signals for driving vehicles and operating devices.

FIG. 14 is a diagram illustrating such a connector. As illustrated in FIG. 14, the existing connector includes a male housing 110, male terminals (not illustrated) protruding from a bottom surface of the male housing 110, a female housing 130 having an one open side and having the male housing 110 inserted thereinto through the one open side, a lever 140 coupled with the male housing, and a TPA (Terminal Position Assurance) 150 for preventing the male housing 110 from being separated from a terminal of the female housing 130. The male housing 110 is inserted through the opened portion of the female housing 130 to electrically connect the male terminals (not illustrated) of the bottom surface of the male housing 110 to the female housing 130.

However, due to the recent increase in number of circuits, a multi-pole circuit connector is required, and the male terminals (not illustrated), disposed on the bottom surface of the male housing 110, may be easily damaged, deformed, warped, and the like.

SUMMARY

The present disclosure has been made to solve the above-mentioned problems occurring in the prior art while advantages achieved by the prior art are maintained intact.

An aspect of the present disclosure provides a lever type connector capable of preventing terminals from being broken, and reducing size of the terminals.

According to an exemplary embodiment of the present disclosure, a lever type connector includes: a female housing having a box shape of which one portion is open; a male housing configured to be inserted into the female housing and provided with a plurality of male terminals; a lever configured to be rotatably coupled with an outer side of the male housing; and a movable plate configured to be mounted on a bottom surface of the male housing, have the bottom surface provided with a plurality of through holes 24 through which the male terminals penetrate, and enclose the male terminals to protect them.

One side of an outer side of the moable plate may be provided with an unlocking member which protrudes and has an inclined surface, a movable plate lock member protruding and spaced apart by a predetermined interval from the inner side wall of the female housing, and may be provided with an elastic material. When the male housing and the movable plate mounted in the male housing are inserted into the female housing, the unlocking member may lift up the movable plate lock member of the female housing to release the lock, and the male housing and the movable plate may be inserted thereinto.

A position fixing member protruding from the outer side of the male housing may be provided, a position support member connected to the unlocking member to form grooves at upper and lower portions may be provided at a position adjacent to the unlocking member of the moving plate, and the position fixing member of the male housing may be inserted into the upper groove formed by the position support member to fix the position of the male housing. When the male housing and the movable plate are inserted into the female housing, the position support member may be deformed by the movable plate lock member of the female housing, the position fixing member may move to the lower groove, and the male housing may be inserted.

A misassembly prevention protrusion member may protrude from one side of the movable plate, extending along an insertion direction of the male housing, and the misassembly prevention protrusion member may penetrate a lock groove, a movable plate fixing member protruding from one side of the outer side of the male housing to be inserted into the lock groove may be prepared, and the male housing may stop being separated in an opposite direction to the insertion direction from the movable plate.

A misassembly prevention member may protrude from the other side of an outer side of the male housing provided with the movable plate fixing member, and the misassembly prevention member may collide with the misassembly prevention protrusion member at the time of misassembly of the male housing with the movable plate to prevent misassembly of the male housing with the movable plate.

The misassembly prevention member may protrude from the other side of the outer side of the mail housing provided with the movable plate fixing member, and the misassembly prevention member may not be inserted into the lock groove but will collide therewith upon misassembly of the male housing with the movable plate to prevent the misassembly.

The lever may be provided with a male coupling hole to be rotatably coupled with the male housing, a rotating guide groove having a predetermined curvature may be formed at one side of the lever, an inner side of the female housing may be provided with a lever guide member protruding as a circular section, and the lever guide member may be inserted into the rotating guide groove when the male housing is inserted into the female housing to guide movement of the lever.

One side of an end of the lever may be provided with an unlocking part having a fork shape, a lever member may be made of an elastic material and protrude at a position adjacent to the end of the lever of the male housing, and one side of the end of the lever may be locked to the lever member to prevent the lever from rotating before the male housing is inserted into the female housing and prevent the lever from reversely rotating.

The other side of the end of the lever may be provided with a lock groove, a position adjacent to the end of the lever may be provided with a protruding lever lock member when the lever of the inner side of the female housing rotates, and the lock groove of the lever may be locked to the lever lock member when the lever rotates to guide a rotating degree of the lever.

BRIEF DESCRIPTION OF THE DRAWINGS

The above and other objects, features and advantages of the present disclosure will be more apparent from the following detailed description taken in conjunction with the accompanying drawings.

FIGS. 13A-1 to 13C-2 is a diagram sequentially illustrating the lever type connector upon insertion, according to the exemplary embodiment of the present disclosure.

DETAILED DESCRIPTION

Hereinafter, exemplary embodiments of the present disclosure will be described in detail with reference to the accompanying drawings.

Figure 1:
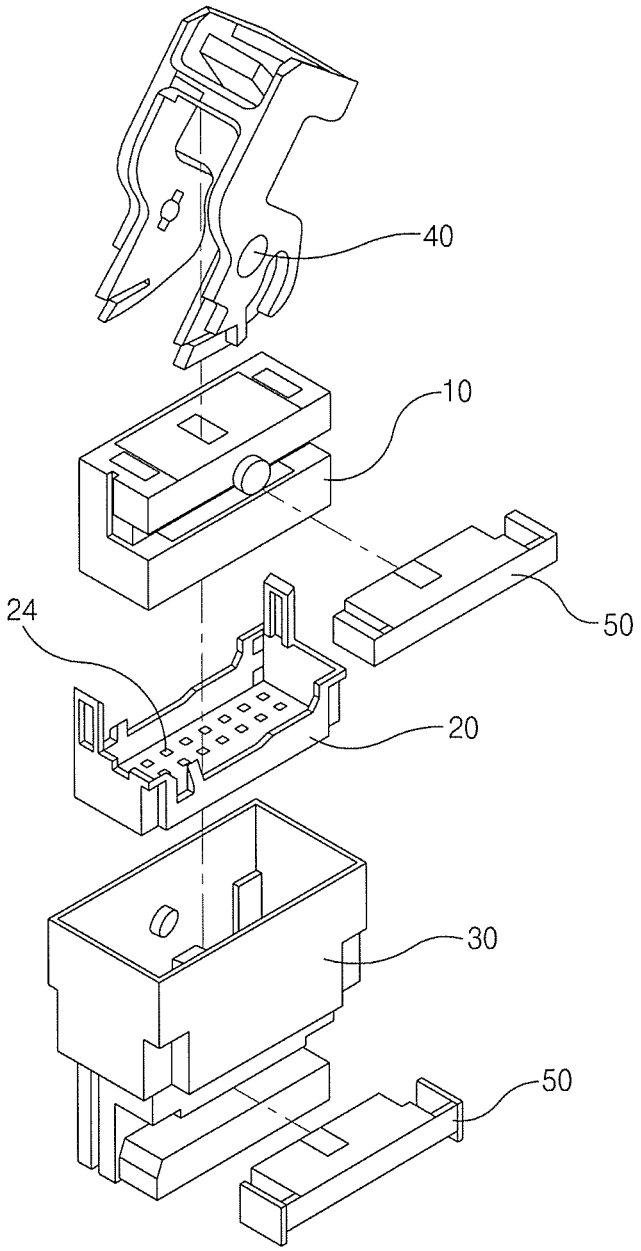
FIG. 1 is an exploded view of a lever type connector according to an exemplary embodiment of the present disclosure.
Figure 2:
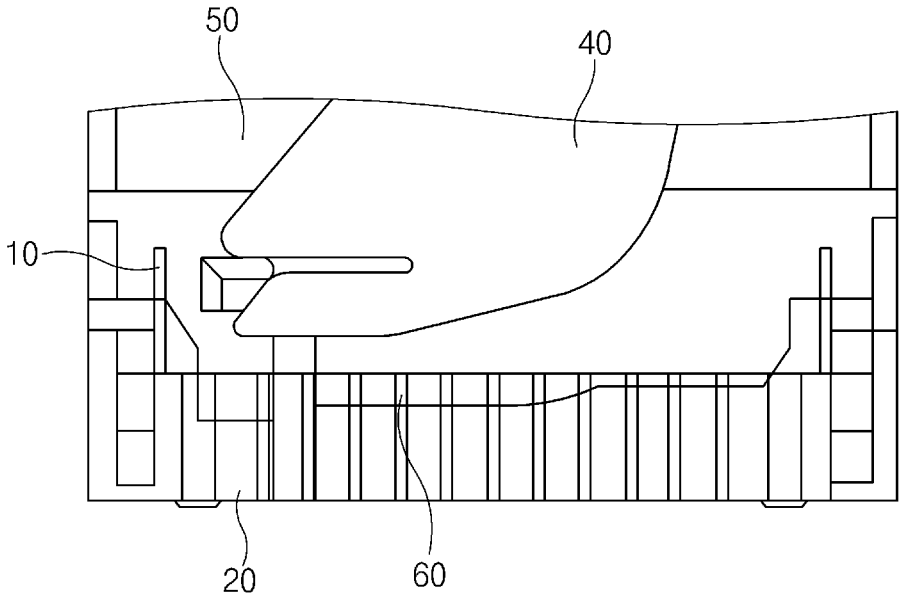
FIG. 2 is a diagram illustrating a moving plate of the lever type connector according to the exemplary embodiment of the present disclosure protecting a male terminal.

As illustrated in FIG. 1, a lever type connector according to an exemplary embodiment of the present disclosure includes a female housing 30 having a box shape of which the one side is open, a male housing 10 disposed to be inserted into the female housing 30 and provided with a plurality of male terminals 60 (FIG. 2), a lever 40 rotatably coupled with the male housing 10, and a movable plate 20 coupled with the male housing 10 to enclose the plurality of male terminals 60 to protect them. Further, the lever type connector is provided with a TPA 50 to prevent the female housing 30 from being separated from terminals of the male housing.

Figure 3:
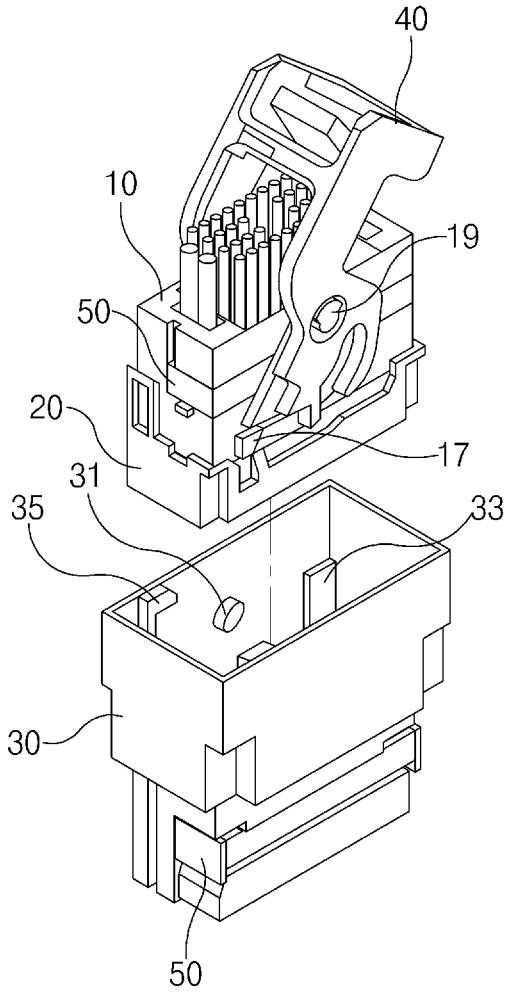
FIG. 3 is a diagram illustrating a male housing of the lever type connector according to the exemplary embodiment of the present disclosure being inserted into a female housing, and coupled with the movable plate.

As illustrated in FIG. 3, the female housing 30 is of a box shape of which the one side is open, and the male housing 10 and the movable plate 20 are inserted through the open portion. An inner side of the bottom surface of the female housing has the male housing, to be described below, inserted thereinto to be electrically connected to the male terminals 60 of the male housing 10. An inner side of the female housing 30 is provided with a protruding movable plate lock member 33 for fixing the movable plate 20, a lever guide member 31 for guiding a movement of the lever 40 to be described below, and a lever lock member 35 for guiding rotation of the lever 40.

Figure 7:
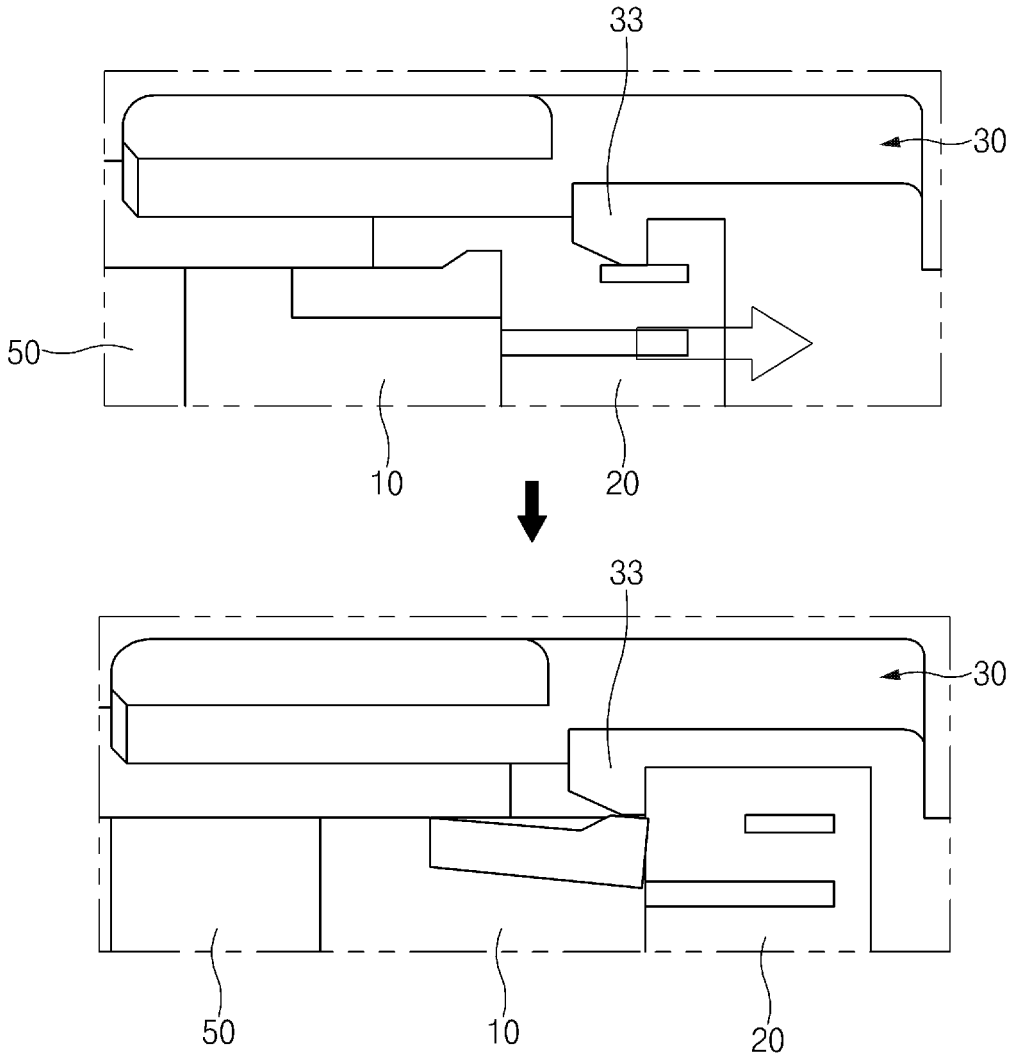
FIG. 7 is a diagram illustrating a lock being released when the male housing and the movable plate of the lever type connector, according to the exemplary embodiment of the present disclosure, are inserted into the female housing.

The movable plate lock member 33 is protrudes from an inner side wall of the female housing 30 by a predetermined distance, has an end having an inclined surface, and is made of an elastic material. When the female housing 30, to be described below, and the movable plate 20 are coupled together, an unlocking member 27 of the movable plate 20, to be described below, is locked to the protruding end, and thus the movable plate lock member 33 fixes an inserted position of the movable plate (see FIGS. 3 and 7).

Figure 8:
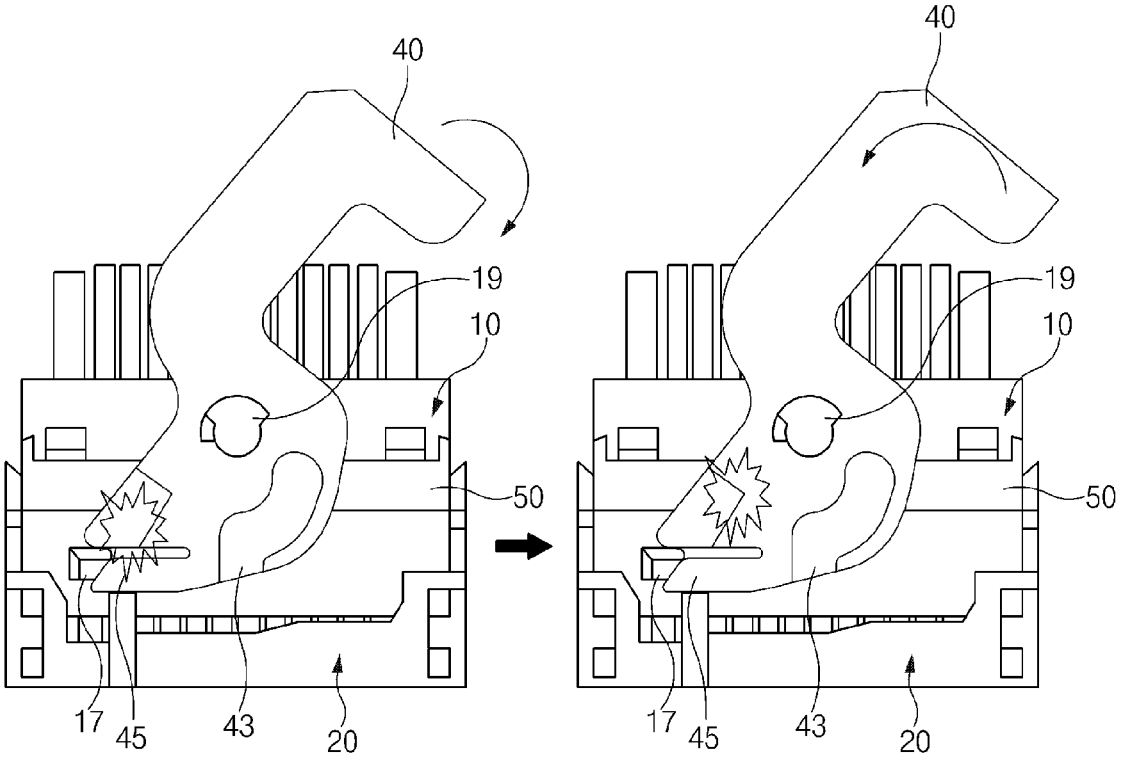
FIG. 8 is a diagram illustrating an anti-rotation structure of a lever of the lever type connector, according to the exemplary embodiment of the present disclosure.
Figure 9A:
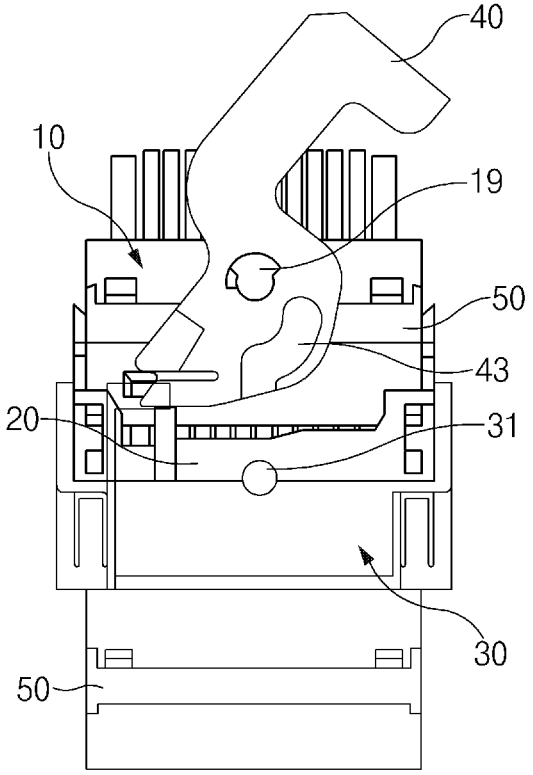
FIGS. 9A to 12B are diagrams illustrating each part depending on an insertion order of the lever type connector, according to the exemplary embodiment of the present disclosure.
Figure 9B:
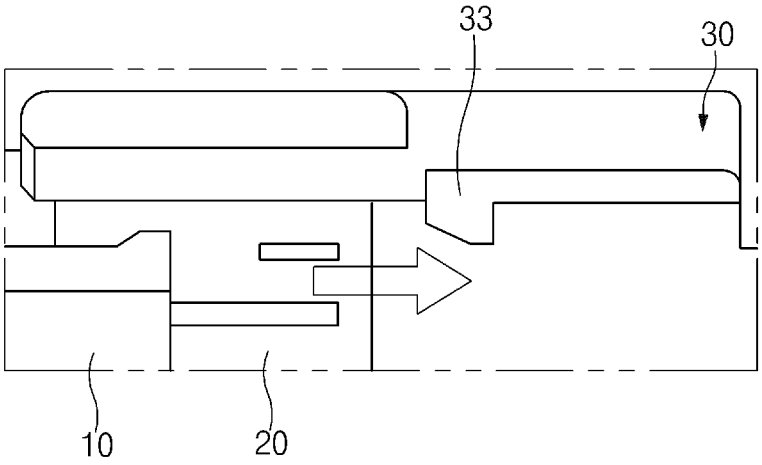
Figure 10A:
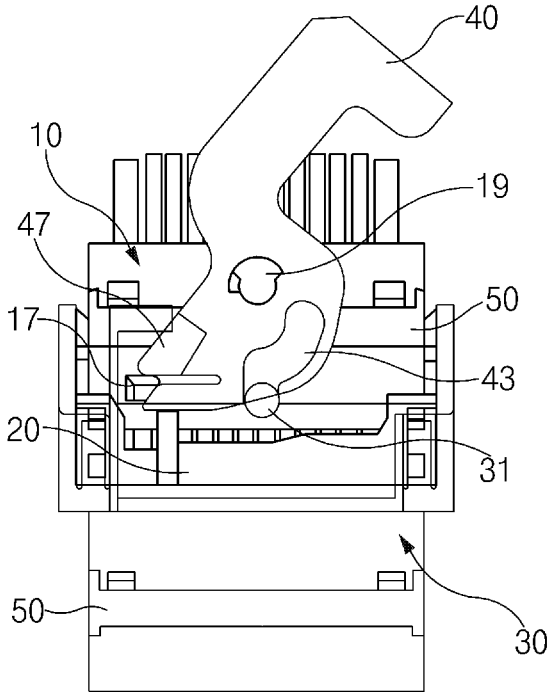
Figure 10B:
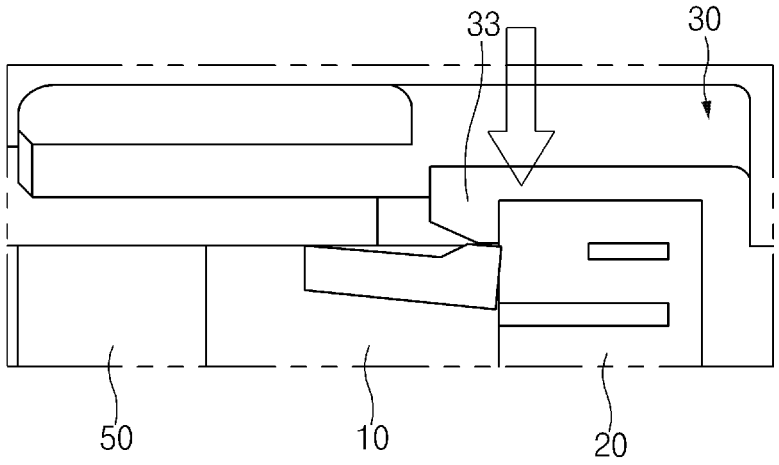

The lever guide member 31 protrudes from the inner side of the female housing 30 and has a circular section. When the male housing 10 is inserted, the lever guide member 31 is coupled with a rotating guide groove 43 formed at the lever 40 coupled with the male housing 10 to guide the lever 40 to move along the rotating guide groove 43 (see FIG. 8).

The lever lock member 35 protrudes from a position adjacent to an opened portion of the female housing 30. When the male housing 10 is inserted, the lever lock member 35 contacts a lock groove 42 formed at the lever 40 coupled with the male housing 10 and guides amount of rotation of the lever 40 to prevent the lever 40 from rotating (see FIG. 8).

Figure 5:
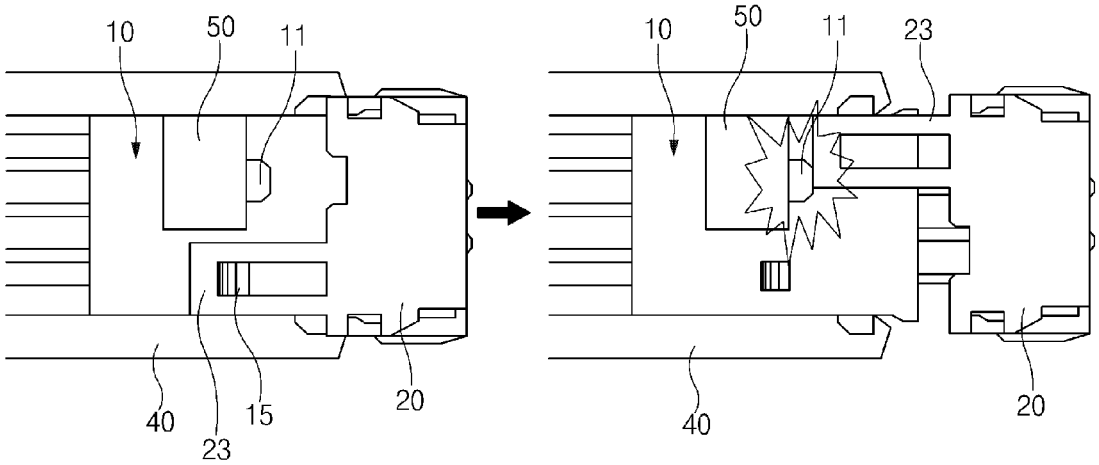
FIG. 5 is a diagram illustrating normal assembly and a misassembly of the male housing of the lever type connector, according to the exemplary embodiment of the present disclosure, with the movable plate.

A bottom surface of the male housing 10 is provided with the plurality of protruding male terminals 60. The male housing 10 may be inserted into the female housing 30, and the bottom surface of the male housing is coupled with the movable plate 20. An outer side of the male housing 10 is provided with a lever coupling hinge 19 to be rotatably coupled with the lever 40. The male housing 10 is provided with a movable plate fixing member 15 (FIG. 5) for preventing the movable plate 20 from being separated to the outside, a position fixing member 18 for fixing a position of the movable plate 20, a lever member 17 for preventing the lever 40 from rotating, and a misassembly prevention member 11 for preventing misassembly with the movable plate 20 (see FIG. 3).

Figure 4:
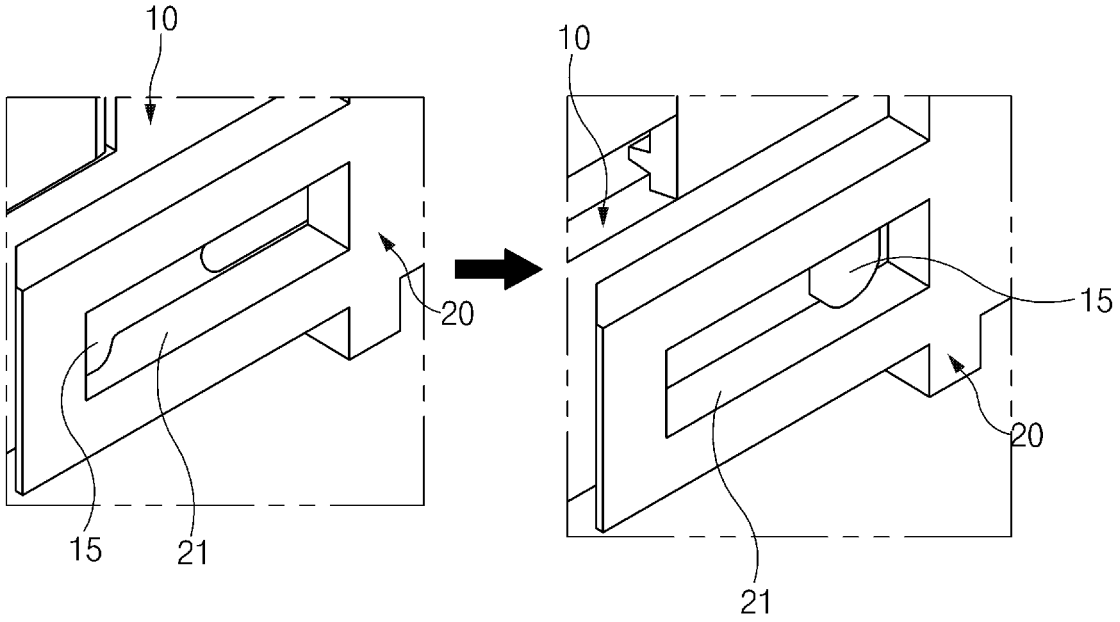
FIG. 4 is a diagram illustrating a misassembly prevention protruding member and a movable plate fixing member of FIG. 3.

The movable plate fixing member 15 protrudes from one side of the male housing 10. The movable plate fixing member 15 is inserted into a lock groove 21 of the movable plate, to be described below, when the movable plate 20 is coupled with the male housing 10. By this configuration, the movable plate fixing member 15 is locked to the lock groove 21 to prevent the male housing 10 from being separated from the movable plate 20 (see FIG. 4).

The position fixing member 18 p a bottom surface adjacent to a position at which the male terminal 60 protrudes. The position fixing member 18 is primarily positioned in an upper groove formed by the position support member 25 of the movable plate 20 so that the movable plate 20 encloses the male terminals 60, thereby maintaining the state in which the movable plate 20 encloses the male terminal 60 of the male housing 10. Next, when the male housing 10 and the movable plate 20 are inserted into the female housing 30, the position support member 25 of the movable plate 20 is deformed, and the position fixing member 18 moves to a lower groove formed by the position support member 25. By this configuration, the state in which the movable plate 20 encloses the male terminal 60 is released and the male terminal 60 protrudes from the moving plate 20 to be electrically connected to the bottom surface of the female housing 30 (see FIG. 7).

The lever member 17 protrudes from the outer side of the male housing 10. The lever member 17 is provided at a position adjacent to an end of the lever 40 of the male housing 10, and is made of an elastic material. The lever member 17 prevents the lever 40 from rotating by being locked to the lever member 17, and prevents the lever 40 from reversely rotating (see FIG. 8).

The misassembly prevention member 11 protrudes from the other side of the outer side of the male housing provided with the movable plate fixing member 15. When the male housing 10 is inserted into the movable plate 20 in the wrong direction, the disassembly prevention member 11 collides with the misassembly prevention protrusion member 23 which is provided with the lock groove 42 of the movable plate 20 to stop the movable plate 20 from being coupled with the male housing 10 (see FIG. 5).

Figure 6:
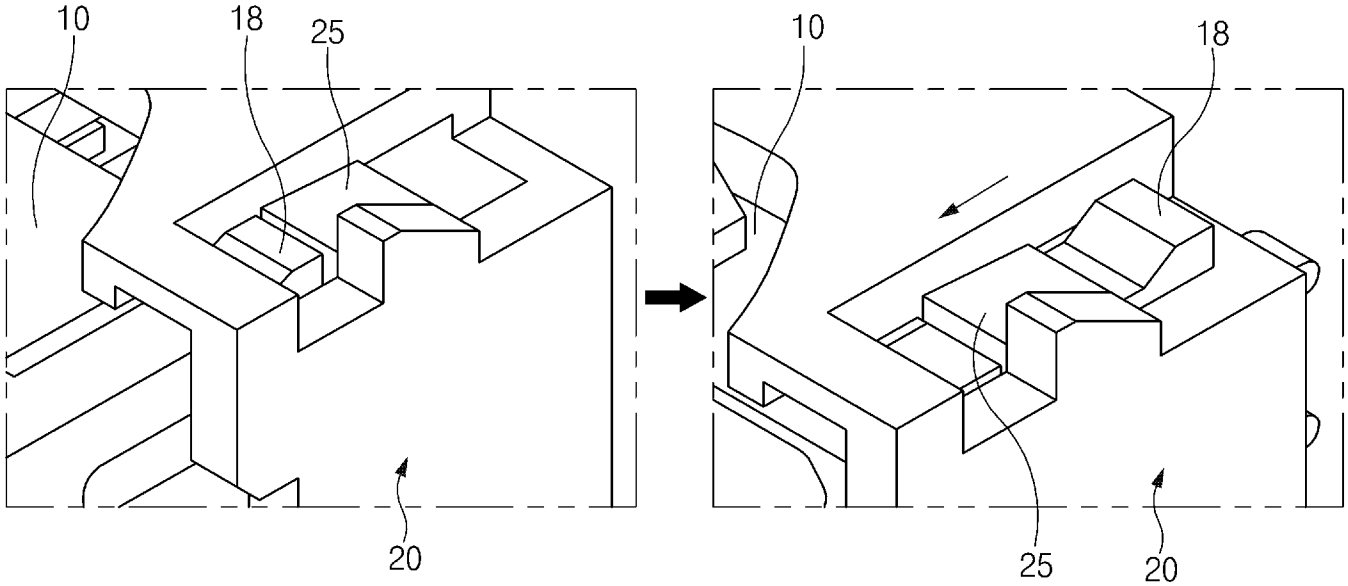
FIG. 6 is a diagram illustrating a position support member of the movable plate of the lever type connector, according to the exemplary embodiment of the present disclosure.

The movable plate 20 is inserted into the female housing 30, and is coupled with the bottom surface of the male housing 10. The movable plate 20 encloses the plurality of male terminals 60 protruding from the male housing 10 to protect the plurality of male terminals 60, thereby preventing the male terminals 60 from being warped or damaged. The movable plate 20 moves when being inserted into the female housing 30, and thus the male terminals 60 enclosed with the movable plate protrude to be electrically connected to the female housing 30. To this end, one side of the outer side of the movable plate 20 is provided with protruding unlocking member 27, having an inclined surface, the misassembly prevention protrusion member 23 for preventing misassembly with the male housing 10 protruding from a side of the movable plate 20, the lock groove 21 which penetrates the misassembly prevention protrusion member 23, and the position support member 25 which supports the inserted position of the male housing 10 (see FIG. 6).

The unlocking member 27 protrudes from one side of the outer side of the movable plate 20, having an inclined surface. The unlocking member 27 is locked to the movable plate lock member 33 of the female housing 30 when the male housing 10 and the movable plate 20 are inserted into the female housing 30, for being coupled with each other. Therefore, the movable plate 20 is not inserted into the female housing 30. Since the movable plate lock member 33 of the female housing 30 is made of the elastic material, the movable plate lock member 33 is deformed and lifted up by the unlocking member 27 (see FIG. 7).

Figure 11A:
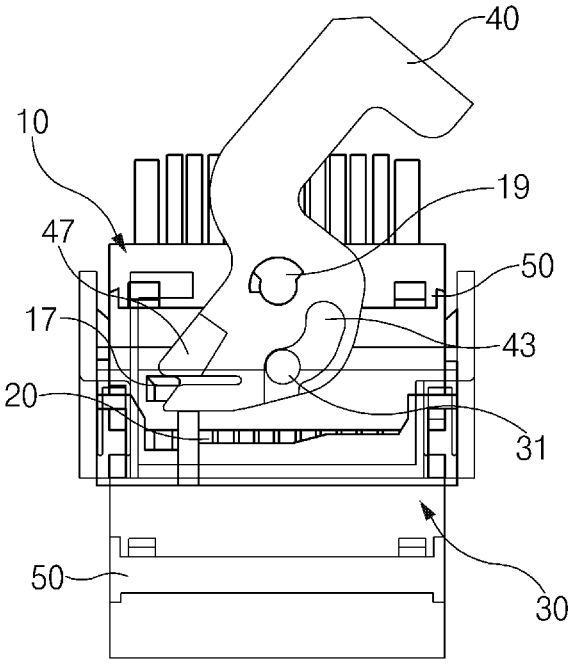
Figure 11B:
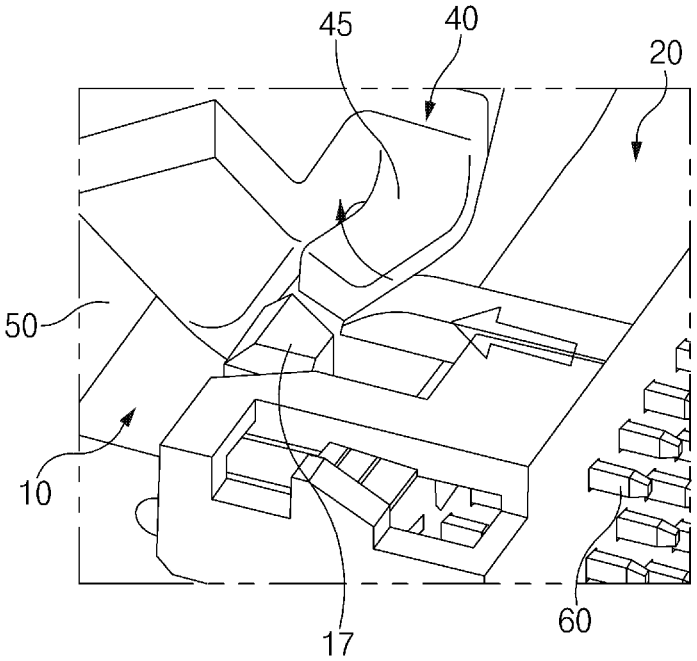
Figure 12A:
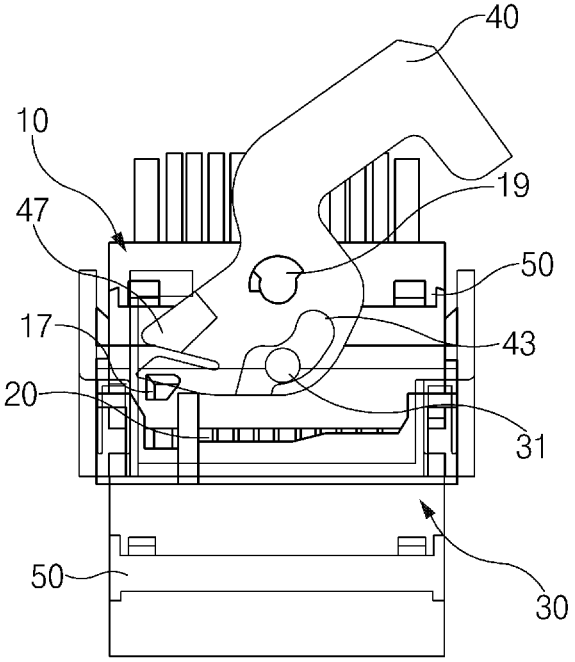
Figure 12B:
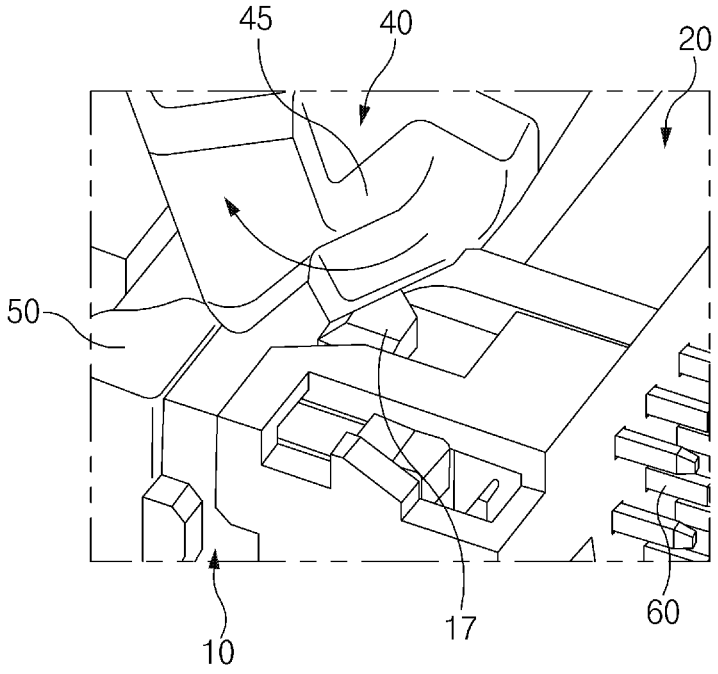
Figures 1, 13A:
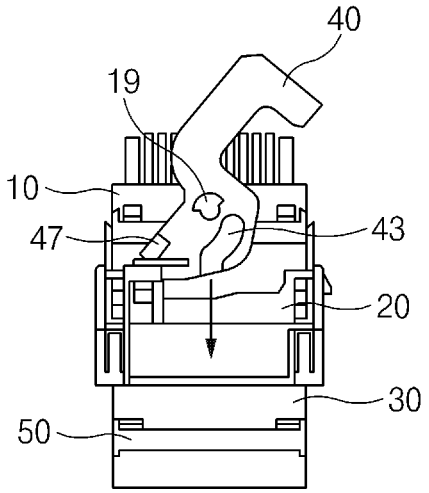
Figures 2, 13A:
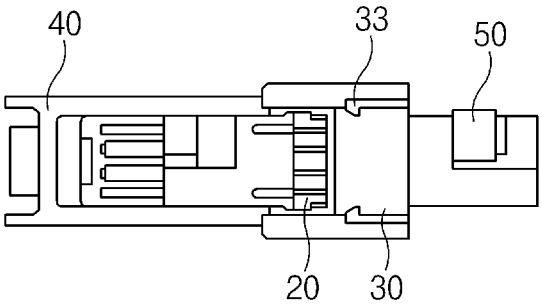
Figures 1, 13B:
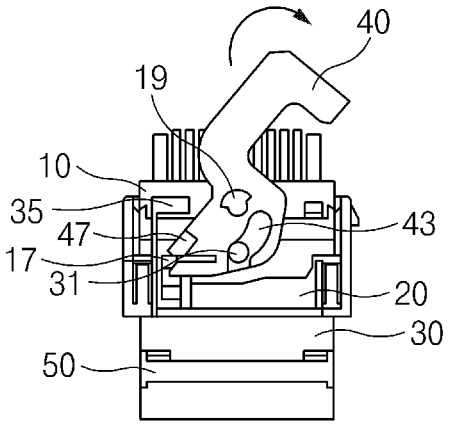
Figures 2, 13B:
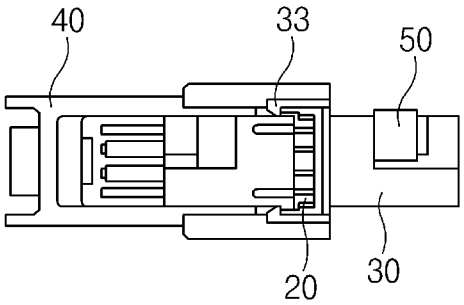
Figures 1, 13C:
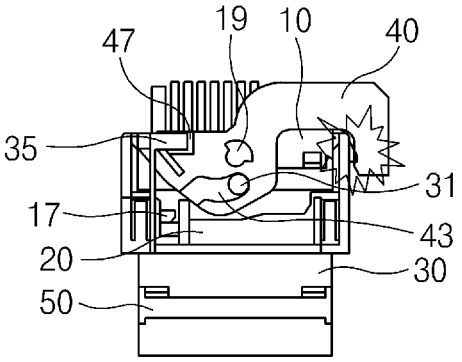
Figures 2, 13C:
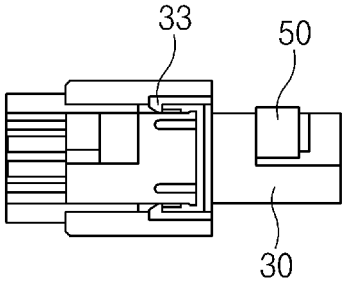
Figure 14:
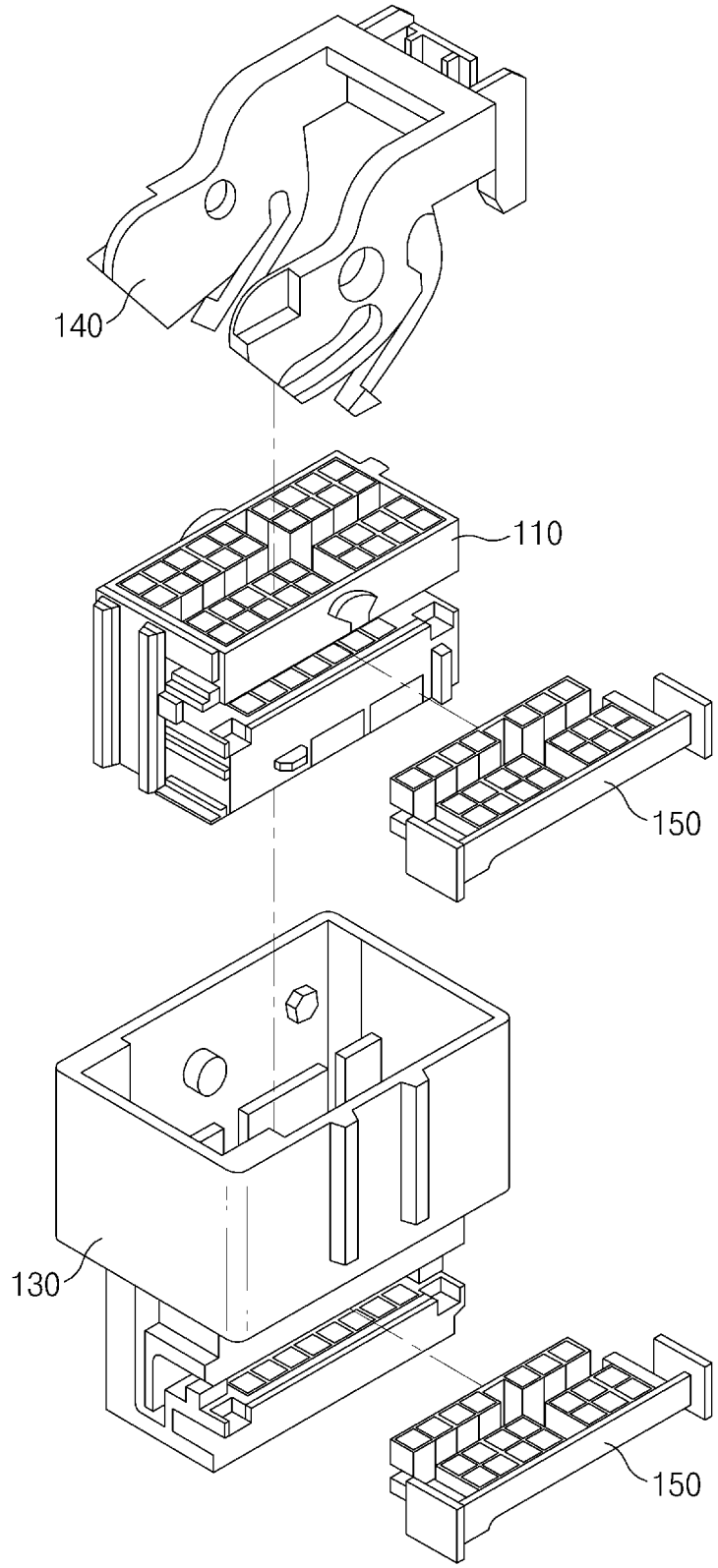
FIG. 14 is a diagram illustrating the existing lever type connector.

The position support member 25 is disposed at a position adjacent to the unlocking member 27. The position support member 25 is connected to the unlocking member 27 and forms grooves at upper and lower portions based on the position support member 25. By this configuration, the position fixing member 18 of the male housing 10 is inserted into the upper groove formed by the position support member 25 to fix the position of the male housing 10, such that the movable plate 20 keeps on enclosing the male terminal 60 of the male housing 10. Next, when the movable plate 20 is inserted into the female housing 30 along with the male housing 10, the movable plate lock member 33 of the female housing 30 is deformed and lifted up by the unlocking member 27, and the position support member 25 is also deformed by the movable plate lock member 33. Therefore, the position fixing member 18 of the male housing 10, which is inserted into the upper groove formed by the position support member 25, moves to the lower groove. Thus the male terminal 60 of the bottom surface of the male housing 10 protrudes from the movable plate 20 to be electrically connected to the female housing 30 (see FIGS. 11A to 11B).

The misassembly prevention protrusion member 23 protrudes while extending upward from the side of the movable plate 20 along the insertion direction of the male housing and penetrates the lock groove 21. That is, the misassembly prevention protrusion member 23 has a shape in which a center thereof is pierced by the lock groove 21. When the male housing 10 is inserted into the movable plate 20 in the wrong direction, the misassembling prevention protrusion member 23 collides with the misassembly prevention member 11 protruding from the outer side of the male housing 10 to prevent the male housing 1 from being coupled with the movable plate 20, thereby preventing misassembly (see FIG. 5).

The lock groove 21 is penetrated by the misassembly prevention protrusion member 23. The lock groove 21 extends along the insertion direction into the female housing 30 of the male housing 10, that is, a length direction of the misassembly prevention protrusion member 23. The lock groove 21 receives the moving plate fixing member 15 of the male housing 10 to prevent the male housing 10 from being separated from the movable plate (see FIG. 4).

A male coupling hole 41 formed at one side of the lever 40 is coupled with the lever coupling hinge 19 of the male housing 10, and thus the lever 40 is rotatably coupled with the male housing 10. The lever 40 has one side provided with the rotating guide groove 43 for guiding movement of the lever 40, an end provided with an unlocking part 45 for preventing the lever 40 from rotating, and one side of the end provided with the lock groove 42 for guiding degree of rotation of the lever 40 (see FIG. 3).

The lever 40 is coupled with the male housing 10, and the end of one side of the lever 40 protrudes outside the male housing 10 and has a bent shape to serve as a handle and fix the coupling of the male housing 10 with the female housing 30.

The rotating guide groove 43 is formed at one side of the lever 40 to have a predetermined curvature. The rotating guide groove 43 is coupled with the lever guide member 31 of the inner side of the female housing 30 to serve as a path through which the movement of the lever 40 is guided to move along the shape of the rotating guide groove 43. By this configuration, as the lever guide member 31 of the inner side of the female housing 30 has a circular section, the rotating guide groove 43 preferably has a curvature to make the lever easily move along the rotating guide groove 43 (see FIG. 8).

The unlocking part 45 is provided at an end of the lever 40 in a fork shape. The protruding lever member 17 of the male housing 10 is locked to the forked portion and thus the unlocking part 45 prevents the lever 40 from rotating and reversely rotating. As the male housing 10 is further inserted, the unlocking part 45 of the lever 40 contacts the movable plate 20 and thus is lifted up by the movable plate 20, such that the lock between the unlocking part 45 and the lever member 17 of the male housing 10 is released. By this configuration, the lever 40 attains a rotatable state, and movement thereof is guided by the lever guide member 31 of the female housing 30 and thus the lever 40 rotates.

The lock groove 42 is formed at the other side of the end of the lever 40. When the lever 40 rotates by a predetermined angle or more, the lock groove 42 is locked to the lever lock member 35 which protrudes from the inner side of the female housing 30 to prevent the lever 40 from continuously rotating. The lock groove 42 is preferably of a shape corresponding to that of the lever lock member 35 of the inner side of the female housing 30.

Hereinafter, the use of the lever type connector according to the exemplary embodiment of the present disclosure will be described with reference to the accompanying drawings. As illustrated in FIGS. 9A to 13C-2, in the lever type connector according to the exemplary embodiment of the present disclosure, the movable plate 20 is first coupled with the bottom surface of the male housing 10. By this configuration, the male terminal 60 of the male housing 10 continues being enclosed by the movable plate 20. Next, the male housing 10 is inserted into the female housing 30. As the male housing 10 is inserted into the female housing 30 while being coupled with the movable plate 20, the unlock member 27 which protrudes with an inclined angle from the movable plate 20 contacts the movable plate lock member 33 of the female housing 30. The movable plate lock member 33 is made of an elastic material and thus is deformed, and the movable plate lock member 33 deforms the position support member 25 of the male housing 10. By this configuration, the male housing 10, which is positioned and supported in the upper groove by the position support member 25 of the movable plate 20, moves to the lower groove and is further inserted into the female housing 30 side. With this configuration, the male terminal 60, which remains enclosed by the movable plate 20, protrudes outside the movable plate 10 to be electrically connected to the female housing 30. Meanwhile, as the male housing 10 is inserted into the female housing 30, the unlocking part 45 of the end of the lever 40, which is in a locked state by the lever member 17 of the outer side of the mail housing 10, is lifted up by the movable plate 20, and thus locking is released. With this configuration, the lever guide member 31 of the female housing 30 is positioned within the rotating guide groove 43 of the lever 40, and the lever 40 rotates and moves with the shape of the rotating guide groove 43. When the lever 40 rotates and thus the lock groove 42 is locked to the lever lock member 35 of the female housing 30, the lever does not rotate further, and the lever 40 is locked to fix the coupling of the male housing 10 with the female housing 30. The unlocking of the male housing 10 with the female housing 30 is performed in a reverse order to an order described above and the detailed description thereof will be omitted herein.

As described above, according to the exemplary embodiment of the present disclosure, it is possible to provide the lever type connector capable of preventing the terminal from being broken and removing the pinching rib included in the existing male housing to reduce the size of the terminal.

It is to be understood that the above-mentioned exemplary embodiments are illustrative rather than being restrictive in all aspects, and the scope of the present disclosure will be defined by the claims rather than the above-mentioned detained description. In addition, all modifications and alternations derived from the claims and their equivalents are to be interpreted to be included in the scope of the present disclosure.

What is claimed is:

1. A lever type connector, comprising:

a female housing of a box shape of which one portion is open;

a male housing configured to be inserted into the female housing and provided with a plurality of male terminals;

a lever configured to be rotatably coupled with an outer side of the male housing; and a movable plate configured to be mounted on a bottom surface of the male housing, have the bottom surface provided with a plurality of through holes through which the male terminals penetrate, and enclose the male terminals for protection thereof.

2. The lever type connector according to claim 1, wherein one side of an outer side of the movable plate is provided with an unlocking member which protrudes and has an inclined surface, a movable plate lock member protrudes and is spaced apart from an inner side wall of the female housing and is provided with an elastic material, and when the male housing and the movable plate mounted in the male housing are inserted into the female housing, the unlocking member lifts up the moving plate lock member of the female housing to release the lock, and the male housing and the movable plate are inserted thereinto.

3. The lever type connector according to claim 2, including a position fixing member protruding from the outer side of the male housing, a position support member is connected to the unlocking member to form grooves at upper and lower portions at a position adjacent to the unlocking member of the movable plate, wherein the fixing member of the male housing is inserted into the upper groove formed by the position support member to fix the position of the male housing, and when the male housing and the movable plate are inserted into the female housing, the position support member is deformed by the movable plate lock member of the female housing, the position fixing member moves to the lower groove, and the male housing is inserted.

4. The lever type connector according to claim 1, wherein a misassembly prevention protrusion member is formed at one side of the movable plate, extending along an insertion direction of the male housing and the misassembly prevention protrusion member penetrates a lock groove, a movable plate fixing member protrudes from one side of the outer side of the male housing to be inserted into the lock groove, and the male housing stops being separated in an opposite direction to the insertion direction from the movable plate.

5. The lever type connector according to claim 4, wherein a misassembly prevention member protrudes from the other side of an outer side of the male housing which is provided with the movable plate fixing member, and the misassembly prevention member collides with the misassembly prevention protrusion member upon a misassembly of the male housing with the movable plate to prevent the misassembly of the male housing with the movable plate.

6. The lever type connector according to claim 1, wherein the lever is provided with a male coupling hole to be rotatably coupled with the male housing, a rotating guide groove having a predetermined curvature is formed at one side of the lever, an inner side of the female housing is provided with a lever guide member protruding as a circular section, and the lever guide member is inserted into the rotating guide groove when the male housing is inserted into the female housing to guide movement of the lever.

7. The lever type connector according to claim 6, wherein one side of an end of the lever is provided with an unlocking part having a fork shape, a lever member is made of an elastic material and protruding at a position adjacent to the end of the lever of the male housing, and one side of the end of the lever is locked to the lever member to prevent the lever from rotating before the male housing is inserted into the female housing and the lever from reversely rotating.

8. The lever type connector according to claim 7, wherein the other side of the end of the lever is provided with a lock groove, a position adjacent to the end of the lever is provided with a protruding lever lock member when the lever of the inner side of the female housing rotates, and the lock groove of the lever is locked to the lever lock member when the lever rotates to guide a rotating degree of the lever.

* * * * *